US007974566B2

(12) United States Patent
Kwon

(10) Patent No.: US 7,974,566 B2
(45) Date of Patent: Jul. 5, 2011

(54) IMAGE-FORMING APPARATUS HAVING APPARATUS FOR PREVENTING ACCUMULATION OF WASTE TONER IN WASTE TONER CONTAINER AND METHOD THEREOF

(75) Inventor: Se-il Kwon, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1102 days.

(21) Appl. No.: 11/699,993

(22) Filed: Jan. 31, 2007

(65) Prior Publication Data

US 2007/0280761 A1 Dec. 6, 2007

(30) Foreign Application Priority Data

Jun. 5, 2006 (KR) ..... 10-2006-0050459

(51) Int. Cl.
*G03G 21/00* (2006.01)

(52) U.S. Cl. ..... 399/358

(58) Field of Classification Search ..... 399/358, 399/360, 257
See application file for complete search history.

(56) References Cited

U.S. PATENT DOCUMENTS

| | | | | |
|---|---|---|---|---|
| 4,360,944 | A * | 11/1982 | Iwai et al. | |
| 4,439,034 | A * | 3/1984 | Daniels | 399/257 |
| 6,353,722 | B1 * | 3/2002 | Klimley et al. | 399/257 |
| 7,480,473 | B2 * | 1/2009 | Matsuura et al. | 399/257 |
| 2004/0052560 | A1 * | 3/2004 | Ishii et al. | 399/360 |
| 2004/0096251 | A1 * | 5/2004 | Ahn et al. | 399/360 |
| 2005/0169649 | A1 * | 8/2005 | Onodera et al. | |
| 2005/0220515 | A1 | 10/2005 | Wakana | |
| 2005/0260018 | A1 * | 11/2005 | Jang et al. | 399/358 |
| 2008/0038014 | A1 * | 2/2008 | Saiki et al. | 399/358 |
| 2008/0075483 | A1 * | 3/2008 | Bito et al. | |

FOREIGN PATENT DOCUMENTS

| | | | |
|---|---|---|---|
| EP | 0382471 | | 2/1990 |
| EP | 0670530 | | 3/1995 |
| JP | 57016472 | A * | 1/1982 |
| JP | 59155878 | A * | 9/1984 |
| JP | 05165382 | A * | 7/1993 |
| JP | 05204281 | A * | 8/1993 |
| JP | 10-69199 | | 3/1998 |
| KR | 10-2003-0044262 | | 6/2003 |

OTHER PUBLICATIONS

Office Action issued in corresponding European Patent Application No. 07103123.1 dated Sep. 21, 2007.
Office Action issued on Jul. 24, 2007 by the Korean Intellectual Property Office for Korean Patent Application No. 2006-50459.
European Search Report for corresponding European Patent Application No. 0710312.1 dated Apr. 13, 2011, 3 pages (In English).

* cited by examiner

*Primary Examiner* — Susan S Lee
(74) *Attorney, Agent, or Firm* — Staas & Halsey LLP

(57) ABSTRACT

An image forming apparatus including: a toner cartridge to store toner; a developer to develop an image on a printing medium using the toner from the toner cartridge; and a waste toner container to store waste toner removed from the developer, wherein the waste toner container includes: a first transporting unit provided near a waste toner inlet; and a second transporting unit provided at a point where the waste toner transported by the first transporting unit falls to transport the waste toner to a farthest point from the waste toner inlet.

43 Claims, 5 Drawing Sheets

IMAGE-FORMING APPARATUS HAVING APPARATUS FOR PREVENTING ACCUMULATION OF WASTE TONER IN WASTE TONER CONTAINER AND METHOD THEREOF

CROSS-REFERENCE TO RELATED APPLICATION

This application claims the benefit of Korean Patent Application No. 2006-50459, filed on Jun. 5, 2006 in the Korean Intellectual Property Office, the disclosure of which is incorporated herein in its entirety by reference.

BACKGROUND OF THE INVENTION

1. Field of the Invention

Aspects of the present invention relate to an image forming apparatus, and more particularly, to an image forming apparatus including a waste toner container to store waste toner.

2. Description of the Related Art

Generally, an image forming apparatus forms a latent image on a photosensitive medium using an exposing unit, such as a laser scanning unit, by first receiving a digital image signal corresponding to a desired image. Then, the image forming apparatus develops the latent image as a toner image using a toner and transfers the toner image to a recording medium to be fused on the recording medium by heat and pressure to print the desired image.

The entire toner image developed on the photosensitive medium is usually not transferred to the recording medium, and a portion of the toner remains on the photosensitive medium. The remaining toner may affect subsequent developing and decreases reliability of the image quality. Accordingly, an image forming apparatus generally includes a waste toner container that can separately store waste toner, which is removed toner that is not reused.

The size of developers has increased with the speed and the lifetime of developers. As the size of the developers increases, the amount of waste toner removed from the developers increases as well. Thus, the size of the waste toner container needs to become larger.

However, as the space required to contain the waste toner has become larger, waste toner flowing from an inlet of waste toner is accumulated only around the inlet and waste toner is not accumulated in a portion far away from the inlet. As a result, the space is not efficiently utilized, and overflow of waste toner out of the inlet may occur.

In order to solve the problem of the overflow of waste toner, a paddle, an auger, or a belt is installed around the inlet of the waste toner to transport the waste toner. However, when a paddle is used, the track of the waste toner is limited such that it is impossible to transport the waste toner a large distance from the inlet of the waste toner. Also, the waste toner may be accumulated at a specific position. When an auger or a belt is used, the operating structure of the auger or the belt is complicated and the waste toner container becomes complicated to assemble.

SUMMARY OF THE INVENTION

Aspects of the present invention provide an image forming apparatus including a waste toner container that can transport waste toner to a farthest point of the waste toner container from an inlet of the waste toner container to prevent accumulation at one specific point, thereby preventing overflow of waste toner.

According to an aspect of the present invention, there is provided an image forming apparatus including: a toner cartridge to store toner; a developer to develop an image on a printing medium using the toner from the toner cartridge; and a waste toner container to store waste toner removed from the developer, wherein the waste toner container includes: a first transporting unit at a first point inside the waste toner container to transport the waste toner away from a waste toner inlet; and a second transporting unit provided at a second point inside the waste toner container to transport the waste toner, transported by the first transporting unit, away from the waste toner inlet.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
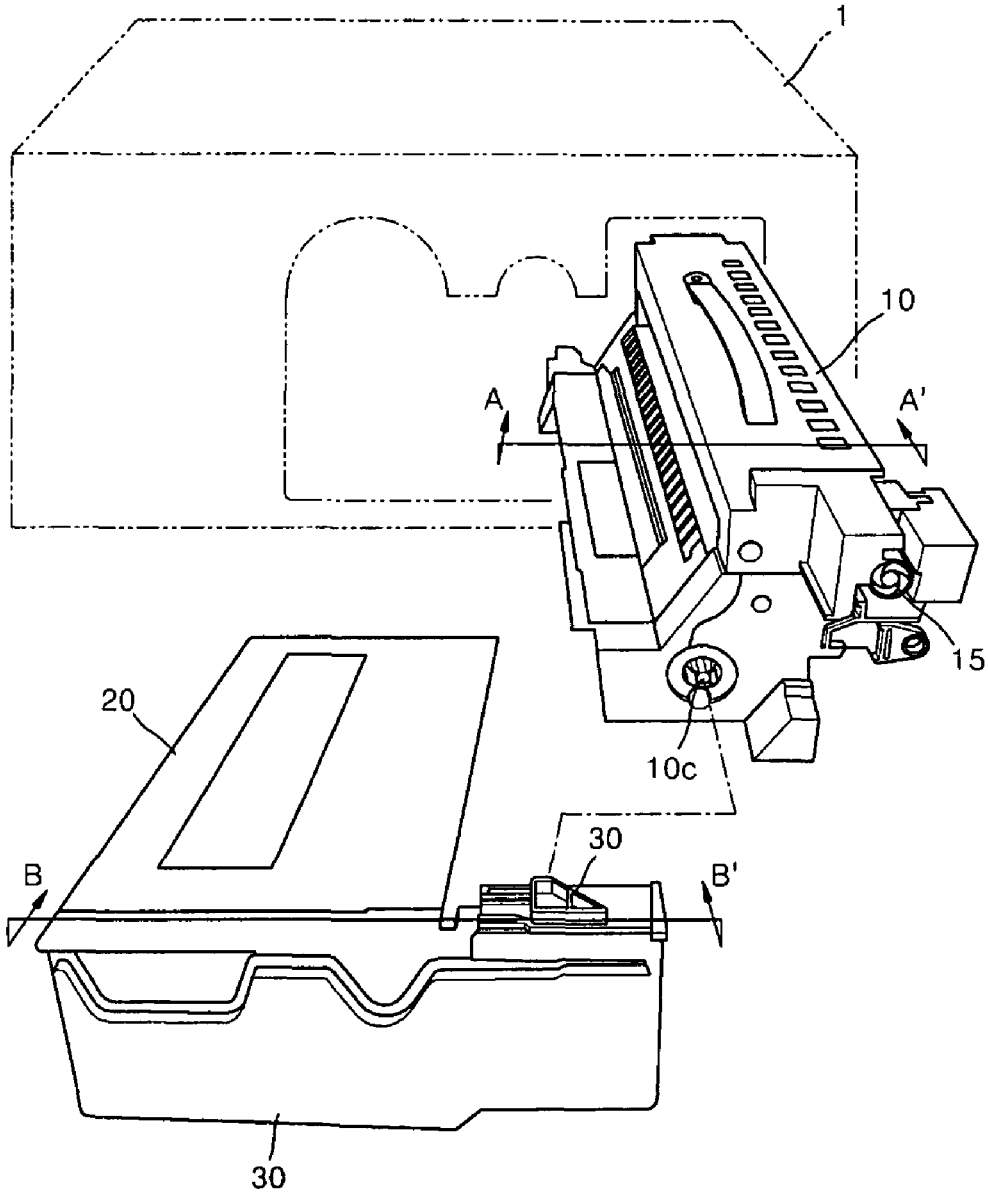
FIG. 1 is a partial perspective view illustrating a toner cartridge and a waste toner container being combined in a developer of an image forming apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
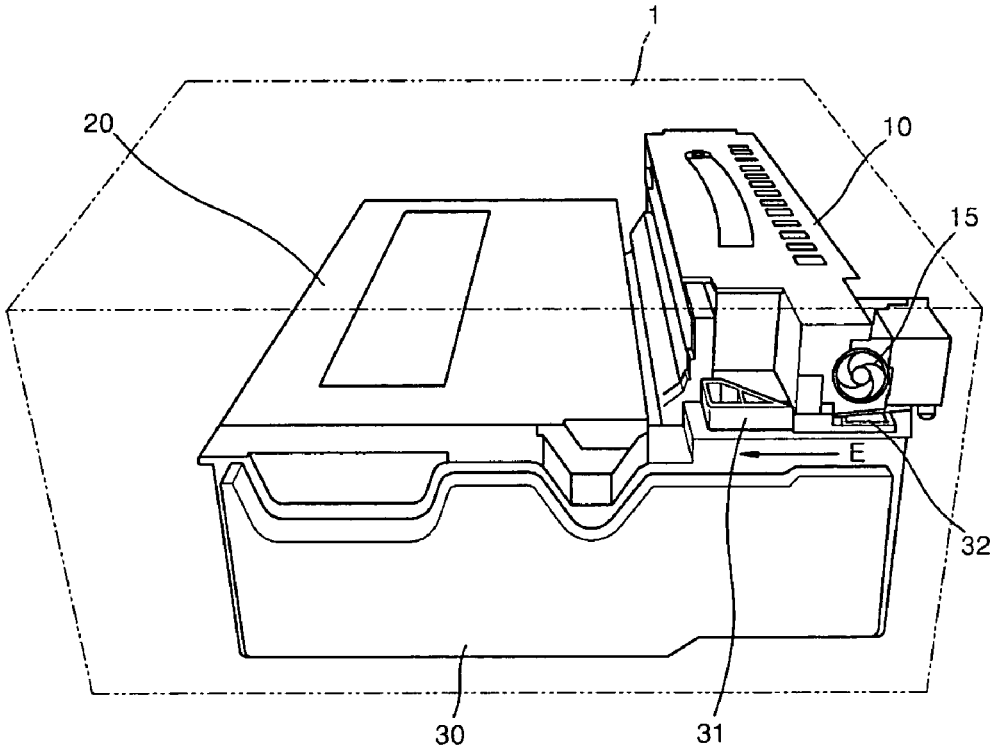
FIG. 2 is a partial perspective view illustrating the toner cartridge and the waste toner container combined in the developer of the image forming apparatus of FIG. 1.
Figure 3:
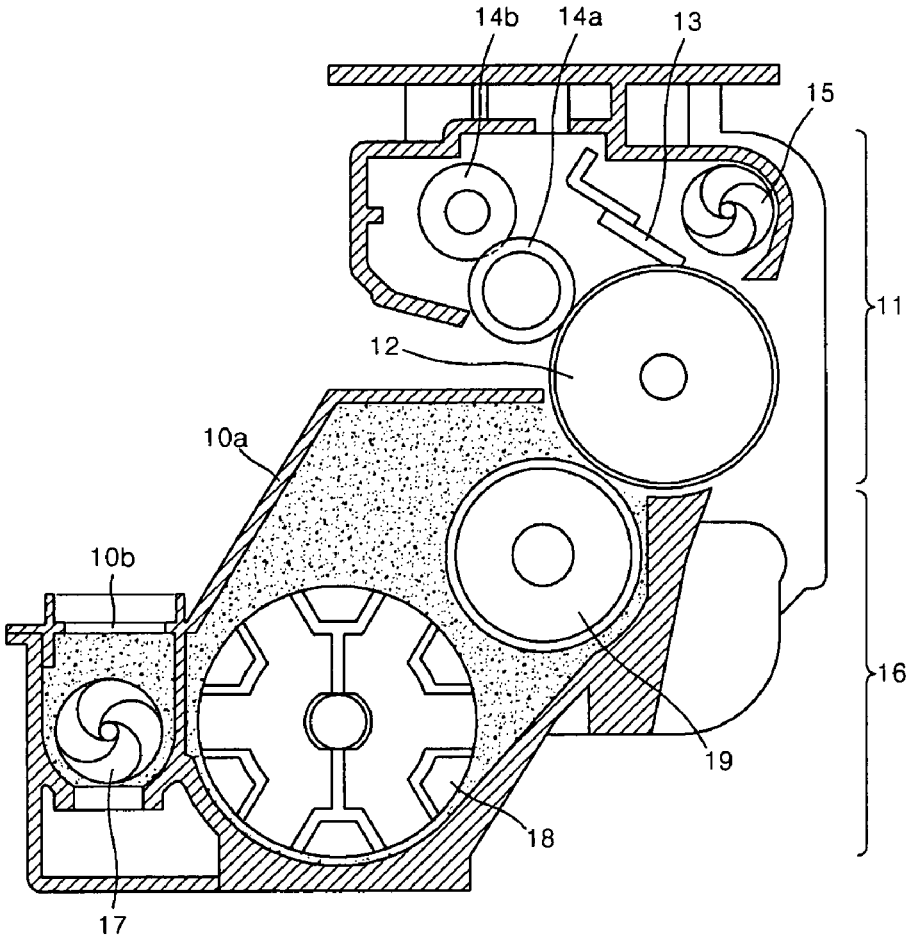
FIG. 3 is a cross-sectional view of the developer of FIG. 1.

Referring to FIGS. 1 through 3, an image forming apparatus, according to an embodiment of the present invention, includes a developer 10 to develop an image, a toner cartridge 20 to store toner, and a waste toner container 30 to store waste toner removed from the developer 10.

The developer 10, as illustrated in FIG. 3, is a bi-component developer developing a latent image using non-magnetic toner and magnetic carriers. FIG. 3 is a cross-sectional view of the developer 10 of FIG. 1 taken along a line A-A'. The developer 10 is surrounded by a housing 10*a*, and can be divided into a developing unit 11 to develop a latent image using toner and a supplying unit 16 to charge the toner and to supply the toner to the developing unit 11.

The developing unit 11 includes a photosensitive medium 12 on which a latent image corresponding to a desired image is formed, a cleaning blade 13 to clean waste toner remaining on the photosensitive medium 12, a charging roller 14*a* to charge the photosensitive medium 12 to a predetermined potential, a cleaning roller 14*b* to clean the charging roller 14*a*, and a waste toner transporting screw 15 to discharge the waste toner removed by the cleaning blade 13 from the photosensitive medium 12 to the outside of the housing 10*a*.

The supplying unit 16 includes an agitating member 17 that is disposed below a toner inlet 10*b*, through which toner from the toner cartridge 20 flows in, and circulates toner in a predetermined direction, a mixer 18 to charge the toner circulated by the agitating member 17 to a predetermined potential so as to attach magnetic carriers to the toner and to supply the toner to a developing roller 19, and the developing roller 19 having a magnet therein to attach the carriers that are attached to the toner to the developing roller 19 and to transfer the toner using the potential difference between the developing roller 19 and the photosensitive medium 12 so as to develop a latent image on the photosensitive medium 12.

As illustrated in FIG. 1, when the developer 10, the toner cartridge 20, and the waste toner container 30 are installed in a body 1, the developer 10, the toner cartridge 20 and the waste toner container 30 are combined to one another as illustrated in FIG. 2. A toner outlet of the toner cartridge 20 is connected in line with the toner inlet 10*b* of the developer 10, and when a shutter 31 disposed on the upper portion of the waste toner container 30 slides in direction E, a waste toner inlet 32 is opened, and an end of the waste toner transporting screw 15 is located at a portion above the waste toner inlet 32. Accordingly, as the waste toner transporting screw 15 rotates, the waste toner is transported into the waste toner container 30 through the waste toner inlet 32.

Figure 4:
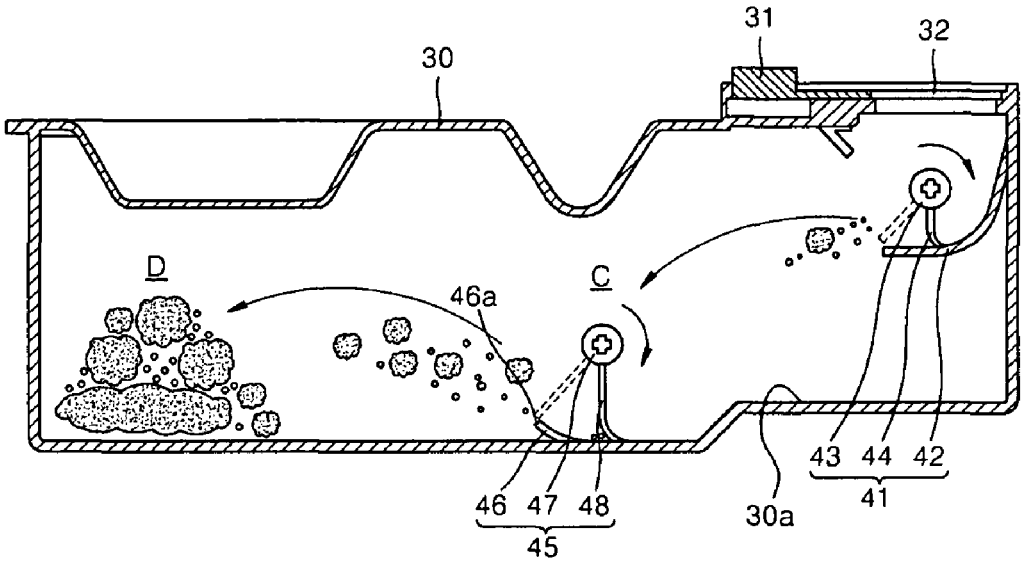
FIG. 4 is a cross-sectional view of the waste toner container of FIG. 1.

FIG. 4 is a cross-sectional view of the waster toner container 30 of FIG. 1 taken along a line B-B'. As illustrated in FIG. 4, the waste toner container 30 includes a first transporting unit 41 and a second transporting unit 45 to transport the waste toner away from the waste toner inlet 32.

The first transporting unit 41 is disposed below the waste toner inlet 32, and the second transporting unit 45 is disposed at C where the waste toner falls by the first transporting unit 41. That is, according to an aspect, the second transporting unit 45 is closer to a bottom surface 30*a* than the first transporting unit 41. In other words, the first transporting unit 41 may be disposed at a higher position from the bottom surface 30*a* than the second transporting unit 45.

The first transporting unit 41 includes a first rib 42 to temporarily collect waste toner falling through the waste toner inlet 32, a first rotation axle 43 disposed above the first rib 42 and rotated by an external driving force, and a first transporting plate 44 that is attached on the first rotation axle 43. The first transporting plate 44 rotates with a rotation of the first rotation axle 43, bends as an end of the first transporting plate 44 contacts the first rib 42, returns to an original position as the contact with the first rib 42 is released, and strikes the waste toner to transport the waste toner. Accordingly, the first transporting plate 44 may be an elastic element and formed of a thin layer.

The second transporting unit 45 includes a second rib 46 formed on the bottom surface 30*a* to temporarily collect waste toner that is transported and falls from the first transporting unit 41, a second rotation axle 47 disposed above the second rib 46 and rotated by an external driving force, and a second transporting plate 48 that is attached on the second rotation axle 47. The second transporting plate 48 rotates with a rotation of the second rotation axle 47, bends as an end of the second transporting plate 48 contacts the second rib 46, returns to an original position as the contact with the second rib 46 is released, and strikes the waste toner to transport the waste toner. An end 46*a* of the second rib 46 may be bent upward to induce the waste toner struck by the second transporting plate 48 to fly to a farthest point D from the waste toner inlet 32. The second transporting plate 48 may be an elastic element and formed of a thin layer. An end of the first rib 42 may be bent upward to function as the second rib 46.

The first rotation axle 43 and the second rotation axle 47 may rotate in an identical direction (clockwise as illustrated in FIG. 4). The rotation direction may be the direction the waste toner is to be transported in.

Figure 5:
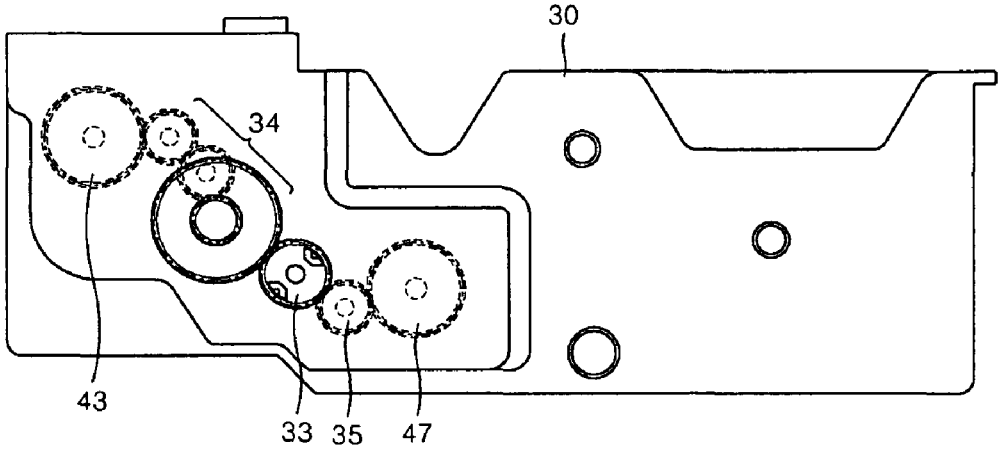
FIG. 5 is a plane view illustrating another side of the waste toner container of FIG. 1.

As illustrated in FIG. 5, according to an aspect, a passive gear 33 is provided at a side of the waste toner container 30, and the first rotation axle 43 and the second rotation axle 47 rotate in an identical direction by receiving a driving force from driving force transferring gears 34 and 35, respectively, that are linked to the passive gear 33.

Meanwhile, referring to FIG. 1, a driving gear 10*c* is provided at a side of the developer 10. When the toner cartridge 20 and the waste toner container 30 are combined in the developer 10, the passive gear 33 of the waste toner container 30 is combined with the driving gear 10*c* of the developer 10, and thus the passive gear 33 can receive a driving force from the driving gear 10*c*.

The waste toner container 30, according to an embodiment of the present invention, includes the first transporting unit 41 and the second transporting unit 45, but is not limited thereto, and other transporting units in accordance with the size and capacity of the waste toner container 30 may be further included.

As described above, aspects of the present invention provide a plurality of transporting units 41 and 45 so that waste toner can be stored farther from a waste toner inlet 32, thereby efficiently utilizing the inner space of a waste toner container 30. Furthermore, the waste toner is prevented from being accumulated at a specific position to prevent overflow of the waste toner. Finally, since low-priced and simple transporting units 41 and 45 are included, the image forming apparatus can be assembled more easily and economically.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A waste toner container to receive and store waste toner removed from a developer of an image forming apparatus, the waste toner container comprising:

a first transporting unit provided at a first point inside the waste toner container to transport the waste toner; and a second transporting unit provided at a second point inside the waste toner container, different from the first point, to transport the waste toner, the second transporting unit including a rib to collect at least some of the waste toner transported by the first transporting unit, wherein the first point is at a higher position from a bottom surface of the waste toner container than the second point.

2. An image forming apparatus comprising:

a developer to develop an image on a printing medium using toner from a toner cartridge; and a waste toner container to store waste toner removed from the developer, the waste toner container comprising:

a first transporting unit provided at a first point inside the waste toner container to transport the waste toner away from a waste toner inlet; and a second transporting unit provided at a second point inside the waste toner container to transport the waste toner, transported by the first transporting unit, away from the waste toner inlet, the second transporting unit including a second transporting unit rib to collect at least some of the waste toner transported by the first transporting unit, wherein, the first point is at a higher position from a bottom surface of the waste toner container than the second point.

3. The image forming apparatus as claimed in claim 2, wherein the first transporting unit comprises:

a first transporting plate to transport the collected waste toner away from the waste toner inlet.

4. The image forming apparatus as claimed in claim 3, wherein the first transporting plate strikes the collected waste toner to transport the collected waste toner away from the waste toner inlet.

5. The image forming apparatus as claimed in claim 3, wherein the first transporting unit further comprises:

a first transporting unit rib to temporarily collect the waste toner falling from the waste toner inlet.

6. The image forming apparatus as claimed in claim 5, wherein the first transporting unit further comprises:

a first rotation axle provided above the first transporting unit rib and attached to the first transporting plate to rotate the first transporting plate such that the first transporting plate strikes the collected waste toner to transport the collected waste toner away from the waste toner inlet.

7. The image forming apparatus as claimed in claim 6, wherein an end of the first transporting plate bends when contacting the first transporting unit rib.

8. The image forming apparatus as claimed in claim 5, wherein an end of the first transporting unit rib is bent upward to direct a transportation direction of the collected waste toner.

9. The image forming apparatus as claimed in claim 6, wherein the second transporting unit comprises:

a second transporting plate to transport the collected waste toner, transported by the first transporting plate, away from the waste toner inlet.

10. The image forming apparatus as claimed in claim 6, wherein the second transporting unit rib projects from the bottom surface of the waste toner container and collects the waste toner, transported by the first transporting unit, until the waste toner is transported by the second transporting unit.

11. The image forming apparatus as claimed in claim 10, wherein the second transporting unit further comprises:

a second rotation axle provided above the second transporting unit rib and attached to a second transporting plate to rotate the second transporting plate such that the second transporting plate strikes the collected waste toner to transport the collected waste toner away from the waste toner inlet.

12. The image forming apparatus as claimed in claim 11, wherein an end of the second transporting unit rib is bent upward to direct a transportation direction of the collected waste toner.

13. The image forming apparatus as claimed in claim 11, further comprising:

a gear to provide a driving force to rotate the first rotation axle and the second rotation axle.

14. The image forming apparatus as claimed in claim 13, wherein the first rotation axle and the second rotation axle receive the driving force causing an identical rotation direction of the first rotation axle and the second rotation axle.

15. The image forming apparatus as claimed in claim 2, wherein the first transporting unit comprises a first transporting plate and wherein the second transporting unit comprises the second transporting unit rib to collect at least some of the waste toner, transported by the first transporting unit; and a second transporting plate to transport the collected waste toner away from the waste toner inlet.

16. The image forming apparatus as claimed in claim 15, wherein an end of the second transporting unit rib is bent upward to direct a transportation direction of the collected waste toner.

17. The image forming apparatus as claimed in claim 16, wherein the second transporting plate strikes the collected waste toner to transport the collected waste toner away from the waste toner inlet.

18. The image forming apparatus as claimed in claim 16, wherein the first transporting unit comprises a first rotation axle and the second transporting unit further comprises:

a second rotation axle provided above the second transporting unit rib and attached to the second transporting plate to rotate the second transporting plate such that the second transporting plate strikes the collected waste toner to transport the collected waste toner away from the waste toner inlet.

19. The image forming apparatus as claimed in claim 18, wherein an end of the second transporting plate bends when contacting the second transporting unit rib.

20. The image forming apparatus as claimed in claim 18, wherein the first transporting unit comprises a first transporting unit rib and an end of the first transporting unit rib is bent upward to direct a transportation direction of the collected waste toner.

21. The image forming apparatus as claimed in claim 2, wherein the first point is below the waste toner inlet.

22. The image forming apparatus as claimed in claim 2, wherein the second point is provided at a location where the waste toner transported by the first transporting unit falls freely.

23. A method of storing waste toner of an image forming apparatus, the method comprising:

receiving the waste toner through a waste toner inlet;

transporting the waste toner away from the waste toner inlet with a first transportation force by a first transporting unit; and transporting the waste toner, transported with the first transportation force, further away from the waste toner inlet with a second transportation force by a second transporting unit, the second transporting unit including a rib to collect at least some of the waste toner transported by the first transporting unit.

24. The method as claimed in claim 23, wherein the transporting of the waste toner with the first transportation force comprises:

collecting the waste toner received through the waste toner inlet; and transporting the collected waste toner with the first transportation force.

25. The method as claimed in claim 24, wherein the transporting of the collected waste toner comprises:

striking the collected waste toner with a first transportation plate to transport the collected waste toner away from the waste toner inlet.

26. The method as claimed in claim 25, wherein the striking of the collected waste toner comprises:

rotating the first transportation plate.

27. The method as claimed in claim 26, wherein the transporting of the waste toner with the second transportation force comprises:

collecting the waste toner transported by the first transportation force with the rib until the collected waste toner is transported by the second transporting unit; and transporting the collected waste toner with the second transportation force.

28. The method as claimed in claim 27, wherein the transporting of the collected waste toner with the second transportation force comprises:

rotating a second transportation plate; and striking the collected waste toner with the second transportation plate to transport the collected waste toner away from the waste toner inlet.

29. The method as claimed in claim 28, wherein:

the rotating of the first transportation plate comprises receiving a driving force from a gear; and the rotating of the second transportation plate comprises receiving the driving force from the gear.

30. The method as claimed in claim 29, wherein:

the rotating of the first transportation plate further comprises rotating in a first direction; and the rotating of the second transportation plate further comprises rotating in the first direction.

31. The method as claimed in claim 23, wherein the transporting of the waste toner with the second transportation force comprises:

collecting the waste toner transported by the first transportation force; and transporting the collected waste toner with the second transportation force.

32. A waste toner container to receive and store waste toner removed from a developer of an image forming apparatus, the waste toner container comprising:

a first transporting unit provided at a first point inside the waste toner container to transport the waste toner; and a second transporting unit provided at a second point inside the waste toner container, different from the first point, to transport the waste toner, the second transporting unit including a second transporting unit rib to collect at least some of the waste toner transported by the first transporting unit, wherein the first point is at a higher position from a bottom surface of the waste toner container than the second point.

33. The waste toner container as claimed in claim 32, wherein the first transporting unit and the second transporting unit transport the waste toner away from a waste toner inlet.

34. The waste toner container as claimed in claim 32, wherein the first transporting unit comprises:

a first transporting plate to transport collected waste toner.

35. The waste toner container as claimed in claim 34, wherein the first transporting unit further comprises:

a first transporting unit rib to collect the waste toner.

36. The waste toner container as claimed in claim 35, wherein the first transporting unit further comprises:

a first rotation axle provided above the first transporting unit rib and attached to the first transporting plate to rotate the first transporting plate such that the first transporting plate strikes the collected waste toner to transport the collected waste toner.

37. The waste toner container as claimed in claim 36, wherein an end of the first transporting plate bends when contacting the first transporting unit rib.

38. The waste toner container as claimed in claim 36, wherein an end of the first transporting unit rib is bent upward to direct a transportation direction of the collected waste toner.

39. The waste toner container as claimed in claim 36, wherein the second transporting unit comprises:

a second transporting plate to transport the collected waste toner.

40. The waste toner container as claimed in claim 39, wherein the second transporting unit rib projects from the bottom surface of the waste toner container to collect the waste toner.

41. The waste toner container as claimed in claim 40, wherein the second transporting unit further comprises:

a second rotation axle provided above the second transporting unit rib and attached to the second transporting plate to rotate the second transporting plate such that the second transporting plate strikes the collected waste toner to transport the collected waste toner.

42. The waste toner container as claimed in claim 40, wherein the second transporting unit rib temporarily collects the at least some of the waste toner transported by the first transporting unit until the waste toner is transported by the second transporting unit and wherein the second point is provided at a location where the waste toner transported by the first transporting unit falls freely.

43. The waste toner container as claimed in claim 34, wherein the first point is below a waste toner inlet.

* * * * *